United States Patent [19]

Deverell

[11] 4,211,042

[45] Jul. 8, 1980

[54] CONTROLLED WELD AREA GRINDING TO PREVENT THE INITIATION OF INTERGRANULAR CORROSION

[75] Inventor: Harry E. Deverell, Natrona Heights, Pa.

[73] Assignee: Allegheny Ludlum Steel Corporation, Pittsburgh, Pa.

[21] Appl. No.: 972,557

[22] Filed: Dec. 22, 1978

[51] Int. Cl.[2] ..... B24B 1/00

[52] U.S. Cl. ..... 51/281 R; 228/125

[58] Field of Search ..... 51/281 R, 290; 138/171; 228/125, 162

[56] References Cited

U.S. PATENT DOCUMENTS

| | | | |
|---|---|---|---|
| 1,954,511 | 4/1934 | Adams | 228/125 |
| 2,223,648 | 12/1940 | Wachowitz | 228/125 |
| 2,763,923 | 9/1956 | Webb | 228/125 |
| 2,794,244 | 6/1957 | Vecker | 228/125 |

OTHER PUBLICATIONS

ASTM Designation:A262-268, "Detecting Susceptibility to Intergranular Attack in Stainless Steels," (Nov. 1968).

ASTM Designation:A268-277, "Seamless and Welded Ferritic Stainless Steel Tubing for General Service," (Nov. 1977).

*Primary Examiner*—Gary L. Smith

*Attorney, Agent, or Firm*—Vincent G. Gioia; William J. O'Rourke, Jr.

[57] ABSTRACT

A method is provided for treating the weld area of a welded ferritic stainless steel article to increase the resistance to intergranular corrosion. This method comprises the step of grinding the torch side surface of the welded article at a substantially uniform depth along the length of the weld after the material has solidified in the weld area, with the cross sectional dimension of the grind extending beyond the weld-base metal interface on both sides of the weld area. In accordance with this method, the depth of grind is uniformly controlled within the range of from at least 0.0005 inch as measured at the weld-base metal interface to less than 10% of the unground article thickness.

4 Claims, 1 Drawing Figure

CONTROLLED WELD AREA GRINDING TO PREVENT THE INITIATION OF INTERGRANULAR CORROSION

BACKGROUND OF THE INVENTION

1. Field of the Invention

The present invention relates to a method of preventing the initiation of intergranular corrosion along the weld area of a welded ferritic stainless steel article, and more particularly to a method of grinding the heat affected zone on the torch side surface of a welded ferritic stainless steel article at a controlled depth along the length of the weld.

2. Description of the Prior Art

In recent years a demand has arisen for stabilized ferritic stainless steel articles such as welded tubing because of their application in extreme corrosion environments. Earlier unstabilized steels such as AISI 405, 410S and 430, were employed but did not exhibit the corrosion resistance required for recent applications. It has been found that welded articles made of ferritic stainless steel, such as 18-2 and 26-1 stainless steel, tend to exhibit sensitization in a shallow layer of the heat affected zone on the torch side of a weld. As used herein sensitization refers to increased sensitivity to intergranular attack in a corrosive media because chromium is combined with carbon and nitrogen rather than uncombined in the material. Although the reason for the phenomenon is not known for sure, it is speculated that weld heat and any atmosphere or lubricants carried or drawn into the weld area provide carbon, nitrogen and a thermal cycle to form chromium compounds.

Sensitization may be a result of contamination at the joined edges of the base metal, excessive heat from the welding operation or dissolution of stabilizing carbides into the heat affected zone. Regardless of the cause, sensitization occurs as the welded article cools from the welding temperatures at or above the melting temperature of the article, probably because carbon and/or nitrogen combines with chromium and locally depletes areas adjacent to grain boundaries.

Welded articles such as ferritic stainless steel tubing must meet intergranular corrosion test requirements as a prerequisite to acceptance or sale and use. During testing and evaluation it has been found that intergranular corrosion is predominantly initiated along the torch side surface of the weld, such as at the outside diameter of welded tubing, particularly at the weld-base metal interface. Accordingly, an effective method is desired for increasing the resistance to intergranular corrosion, and ideally for preventing the initiation of such intergranular corrosion.

In accordance with the present invention, a controlled grinding operation performed on the torch side surface of the weld on a surface area that exceeds the extent of the weld, and at a uniform depth along the length of the weld prevents the initiation of intergranular corrosion. Grinding of welded articles, such as tubing, has been practiced in the past. However, such grinding operations have been performed for aesthetic reasons. For example, it is desirable to have the exposed weld bead cosmetically dressed to enhance the appearance of the tube. Also, ornamental welded pipe is ground around the entire periphery of the outside surface to obtain a generally uniform appearance. Such prior art decorative grinding is not performed on a surface area that necessarily exceeds the weld area, and does not require a substantially uniform depth of grind along the length of the weld. Thus, such practices of cosmetically manicuring a weld bead would not prevent the initiation of intergranular corrosion.

Accordingly, an economical and effective process is desired for assuring that intergranular corrosion is not initiated at the weld-base metal interface of a welded ferritic stainless steel article.

SUMMARY OF THE INVENTION

This invention may be summarized as providing a process for treating the weld area of a welded ferritic stainless steel article to increase the resistance to intergranular corrosion by preventing the initiation of attack. This process comprises the step of grinding the torch side surface of the welded article at a substantially uniform depth along the length of the weld after the material has solidified in the weld area, with the cross sectional dimension of the grind extending beyond the weld-base metal interface on both sides of the weld area. By this process, the depth of grind is uniformly controlled within the range of from at least 0.0005 inch as measured at the weld-base metal interface to less than 10% of the article thickness as measured at the unground surface.

In accordance with the method of the present invention, the initiation of intergranular corrosion is prevented. Thus, following the treatment method of this invention results in increasing the percentage of material which will meet the established intergranular corrosion test requirements for such ferritic stainless steel materials.

This invention will be more fully understood and appreciated with reference to the following detailed description and the drawings appended hereto.

DESCRIPTION OF THE PREFERRED EMBODIMENTS

Figure 1:
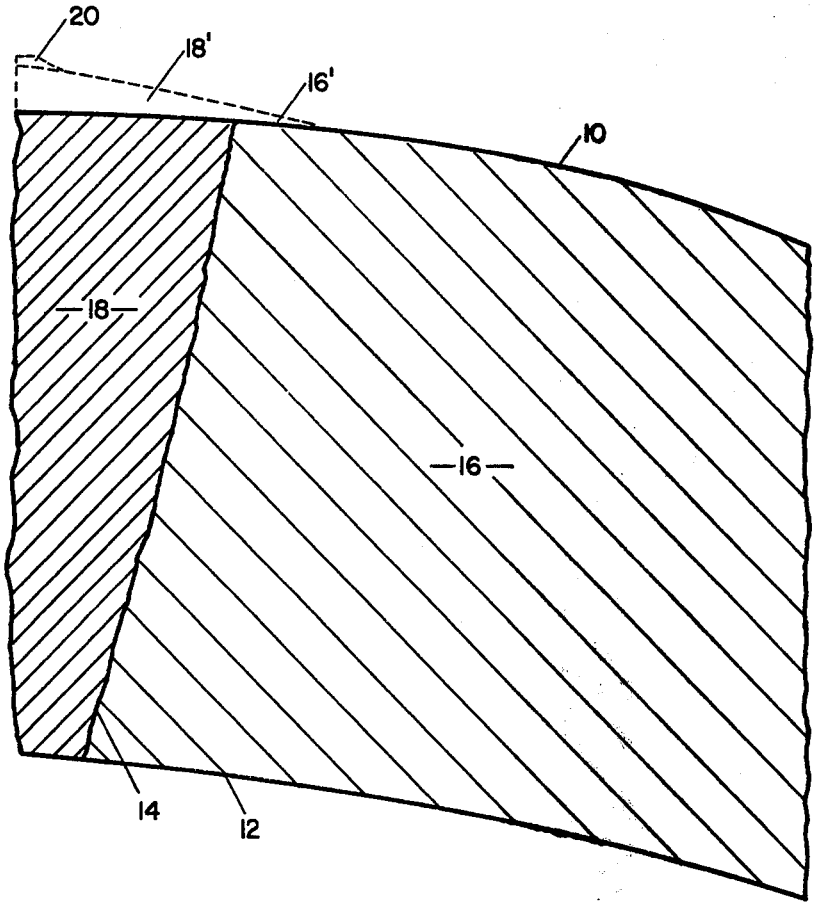
FIG. 1 of this invention is an enlarged, fragmentary cross sectional view of a welded pipe beaded in accordance with the present invention showing the ground area in phantom lines.

Although the present invention is directed to any welded ferritic stainless steel article the invention is particularly adapted to welded tubing. Therefore, the following description will be directed specifically to welded tubing, but such emphasis should not be considered a limitation on the scope of this invention. Referring particularly to the drawing, the figure illustrates a typical welded tube which includes an outer peripheral surface 10 and an inside surface 12 which define the outside and inside diameters respectively, of the tube.

In the manufacture of tubular metal products, hot rolled strip, or plate is utilized. The gage of the strip corresponds to the desired thickness of the wall of the pipe to be formed. Typically, the edges of the strip are trimmed to obtain an accurate width dimension. Then the strip is curled into a cylindrical shape with the edges abutting. An electrode heats the butted area to weld the pipe. Preferably the weld is conditioned by a bead working device to insure that the weld is laid substantially flush with the inside and outside surfaces 12 and 10 of the tube. After welding the curled edges of the strip define the interfacial boundary 14 between the base metal 16 of the strip and the weld area 18 of the tube.

Even when the weld is laid flush with the adjacent base metal surfaces the outside surface 10 of the weld area 18, also called the face of the weld or the torch side surface of the weld, typically exhibits intermittent high spots, such as shown by reference numeral 20. For this reason, grinding belts may be provided in tube welding mills to hit such high spots and buff the rough appearance of the weld. This grinding operation is used only to cosmetically dress the weld.

In accordance with the present invention, the entire outside surface of the weld area is subjected to grinding. Additionally, a portion of the outside surface of the base metal at the interface 14 must also be ground to a minimum depth of 0.0005 inch. The maximum amount of grinding is based on the permissible variation in wall thickness of the welded article. ASTM Specification A268 sets forth a permissible variation of as much as plus or minus 10% for tubing having an outside diameter of from 0.5 to 8.0 inch. Thus, for a pipe having a wall thickness of 0.065 inch the wall may be ground to as low as 0.0585 inch at any location therearound and still be acceptable.

In accordance with the present invention, the entire weld area must be ground and a portion of the base metal outside the weld area must also be ground to a depth of at least 0.0005 inch as measured at the weld-base metal interface 14. The entire grinding operation must not reduce the wall thickness of the welded article by more than 10% at any location.

The area which has been ground is shown in phantom lines in the drawing. Thus, the grinding operation is designed to remove not only an outer peripheral portion 18′ of the weld area 18, but also an outer peripheral portion 16′ of the base metal 16 at the interface 14. It will be understood that the grinding operation is performed on both sides of the weld area 18, and that the depth of grind is substantially uniform at any cross-sectional location along the length of the tube.

It will be understood by those skilled in the art that the present invention is particularly beneficial for treating the weld area of low interstitial vacuum induction melted ferritic steel. Benefits are obtained with such steel because small changes of carbon and nitrogen therein produce relatively larger percentage changes in carbon and nitrogen analysis of the low interstitial material.

Examples

Vacuum melted 26-1 stainless steel, i.e. 26% chromium—1% molybdenum low interstitial columbium stabilized stainless steel, was rolled into strip of 0.065 inch gage. The rolled strip was degreased, then annealed at a temperature of about 1650° F. for about five minutes furnace time, water quenched, blasted and pickled. The strip was then welded into stainless steel tubing having an outside diameter of two inches, by curling the strip and passing a weld in the longitudinal direction at about 14.5 volts, 120–125 amps with a 1/16 inch diameter tapered tungsten electrode at a rate of about 25 inches per minute.

Comparative intergranular corrosion tests were made using the as-processed surface and using surfaces in which at least a portion of the base metal is ground in accordance with the present invention. The test specimen was a 1 inch by 2 inch sample with the weld passed in the 2 inch direction. Integranular corrosion was measured by the Streicher Test, more commonly recognized as ASTM A 262, Practice B. This test indicates penetration rates, in inches per month, by exposing the test specimen to a boiling solution containing 2% ferric sulfate and 50% sulfuric acid after 120 hours of exposure. It should be noted that the maximum allowable penetration rate, as is typically agreed upon between commercial producers and users, is 0.0020 inches per month. The following table illustrates the consistently improved resistance to intergranular corrosion when employing the method of the present invention:

| | Penetration Rates (Inches Per Month) | |
|---|---|---|
| Example | Base Metal Ground | Base Metal Not Ground |
| 1 | .00099 | .00160 |
| 2 | .00095 | .00156 |
| 3 | .00098 | .00160 |
| 4 | .00097 | .00217 |
| 5 | .00093 | .00225 |
| 6 | .00094 | .00235 |
| 7 | .00137 | .00173 |
| 8 | .00136 | .00176 |
| 9 | .00137 | .00170 |
| 10 | .00102 | .00165 |
| 11 | .00107 | .00155 |
| 12 | .00104 | .00154 |

Similar comparative intergranular corrosion tests were made in accordance with the DuPont Cupric Test, which indicates penetration rates in inches per month by exposing a test specimen to a solution containing 6% copper sulfate and 50% sulfuric acid, with a copper bar immersed in the solution. The following table illustrates consistently lower penetration rates when employing the method of the present invention:

| | Penetration Rates (Inches Per Month) | |
|---|---|---|
| Example | Base Metal Ground | Base Metal Not Ground |
| 13 | .00045 | .00128 |
| 14 | .00052 | .00132 |
| 15 | .00050 | .00126 |
| 16 | .00067 | .00120 |
| 17 | .00064 | .00132 |
| 18 | .00063 | .00140 |
| 19 | .00074 | .00133 |
| 20 | .00074 | .00157 |
| 21 | .00075 | .00145 |
| 22 | .00065 | .00138 |
| 23 | .00068 | .00138 |
| 24 | .00065 | .00121 |

The penetration rates of the welded tube in which a portion of the base metal has not been ground, is within acceptable limits in the majority of the above examples. However, it has been found that such marginally stabilized materials tend to exhibit a thin line, such as 0.020 inch wide, in which more severe intergranular attack occurs. Such thin areas may be etched on grain boundaries when the tube is put into service, which could lead to chloride crevice attack of further intergranular penetration depending upon the particular service conditions. Therefore, it is desirable to produce welded stainless steel tubing which exhibits superior resistance to intergranular attack.

Whereas the particular embodiments of this invention have been described above for the purposes of illustration it will be apparent to those skilled in the art that numerous variations of the details may be made without departing from the invention.

What is claimed is:

1. A method of treating the weld area of a welded ferritic stainless steel article to increase the resistance to intergranular corrosion comprising the step of grinding the torch side surface of the welded article at a substantially uniform depth along the length of the weld after the material has solidified in the weld area, with a cross sectional dimension of the grind extending beyond the weld-base metal interface on both sides of the weld area, and with the depth of grind being uniformly controlled within the range of from at least 0.0005 inch as measured at the weld-base metal interface to less than 10% of the unground article thickness.

2. A method as set forth in claim 1 wherein the article is low interstitial vacuum induction melted ferritic steel.

3. A method of treating the weld area of a welded ferritic stainless steel tubing to increase the resistance to intergranular corrosion by preventing the initiation of intergranular attack, comprising the step of grinding the outside diameter of the tubing at a substantially uniform depth along the length of the weld after the weld has been laid flush with the outer peripheral surface of the tubing and after the material has solidified in the weld area, with the cross sectional dimension of the grind extending through an arc traversing the weld, and with the depth of grind being uniformly controlled within the range of from at least 0.0005 inch as measured at the weld-base metal interface to less than 10% of the wall thickness of the tube as measured at the unground surface.

4. A method as set forth in claim 3 wherein the tubing is made from low interstitial vacuum induction melted ferritic steel.

* * * * *